United States Patent [19]

Brewaeys et al.

[11] 4,408,693

[45] Oct. 11, 1983

[54] BLISTER PACK

[75] Inventors: Luc Brewaeys; Maurice Hens, both of Wilrijk, Belgium

[73] Assignee: CMP Chemical & Metallurgical Products Ltd., Switzerland

[21] Appl. No.: 300,504

[22] Filed: Sep. 9, 1981

[30] Foreign Application Priority Data

Sep. 19, 1980 [BE] Belgium ..... 202157

[51] Int. Cl.[3] ..... B65D 5/64; B65D 43/00

[52] U.S. Cl. ..... 206/461; 206/469; 206/45.34; 229/43

[58] Field of Search ..... 206/461, 469, 470, 45.34, 206/508, 503; 229/43; 220/307

[56] References Cited

U.S. PATENT DOCUMENTS

| | | | |
|---|---|---|---|
| 2,931,493 | 4/1960 | Pfohl . | |
| 3,055,540 | 9/1962 | Ringlen | 220/307 |
| 3,339,728 | 9/1967 | Werner . | |
| 3,344,974 | 10/1967 | Bostrom | 229/43 |
| 3,382,972 | 5/1968 | Phipps . | |
| 3,463,309 | 8/1969 | Szostek | 206/470 |
| 3,533,503 | 10/1970 | Wood | 206/45.19 |
| 3,666,087 | 5/1972 | Cooper | 206/45.34 |
| 3,749,236 | 7/1973 | Dahl | 206/45.34 |
| 4,346,833 | 8/1982 | Bernhardt | 229/43 |

FOREIGN PATENT DOCUMENTS

| | | | |
|---|---|---|---|
| 662910 | 5/1963 | Canada | 206/469 |
| 2457817 | 5/1979 | France . | |
| 1580791 | 12/1980 | United Kingdom | 206/469 |

*Primary Examiner*—William T. Dixson, Jr.

*Attorney, Agent, or Firm*—Scully, Scott, Murphy & Presser

[57] ABSTRACT

There is described a blister pack, which is formed by a box-shaped holder with a cover fitting thereon, whereby the box-like holder is provided in turn with a rim wherewith said holder can be made fast to a support, such as a flat sheet.

3 Claims, 2 Drawing Figures

BLISTER PACK

This invention relates to a blister pack.

By "blister pack" is generally understood a box-shaped holder for bringing to sale the most varied goods. Such blister packs are much used for selling spikes, screws, washers, plugs, etc.

The generally transparent box-shaped holder which forms the blister pack, is made fast by welding to a support, such as plastified cardboard or similar.

Opening of the box-shaped holder is generally not quite simple as cardboard pieces still cling to the holder in such a way that the box-shaped holder cannot be kept for further use.

Actually blister packs or rather holders with a transparent cap are known, whereby the holder is designed for repeated use, which means that the holder with the cover thereof may be used continuously. Such holders are described in U.S. Pat. Nos. 2,931,493, 3,666,087 and 3,749,236.

Similar transparent packs with a cover which is either slidable to-and-fro relative to the box, or removable from said box are known from U.S. Pat. Nos. 3,382,972, 3,339,728, and 3,533,503.

Not one of the above patents appears to deal with the problem raised in that case where either the cover or the box is welded to a support, even if however measures are proposed to retain a box with cover after cutting loose the one such component.

The invention has thus for object to provide a blister pack which can easily be cut out from the support it is welded on, whereby the holder with cover released from said support may be used as box.

To this end the blister pack according to the invention is formed by a box with a cover fitting thereon, whereby the box is provided in turn with a rim wherewith said box may be made fast to a support, such as a flat sheet.

Advantageously said box rim is wider than the cover and the wider part is made fast, preferably by welding, to said support.

Other details and features of the invention will stand out from the following description, given by way of non limitative example and with reference to the accompanying drawings, in which.

Figure 2:
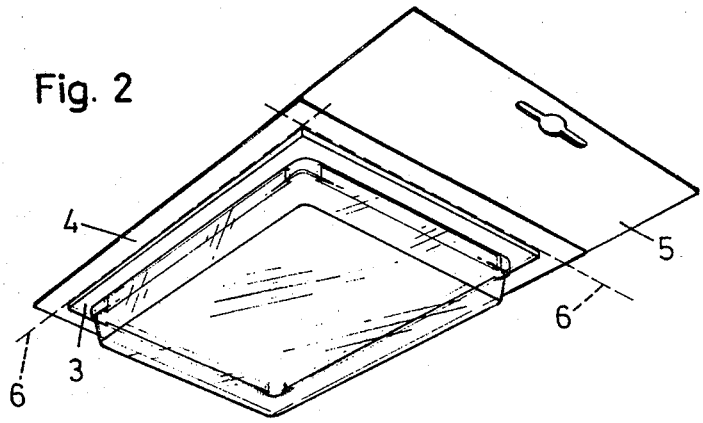
FIG. 2 is a perspective showing of the blister pack, after the wider rim of the box-like holder has been welded on the support.
Figure 1:
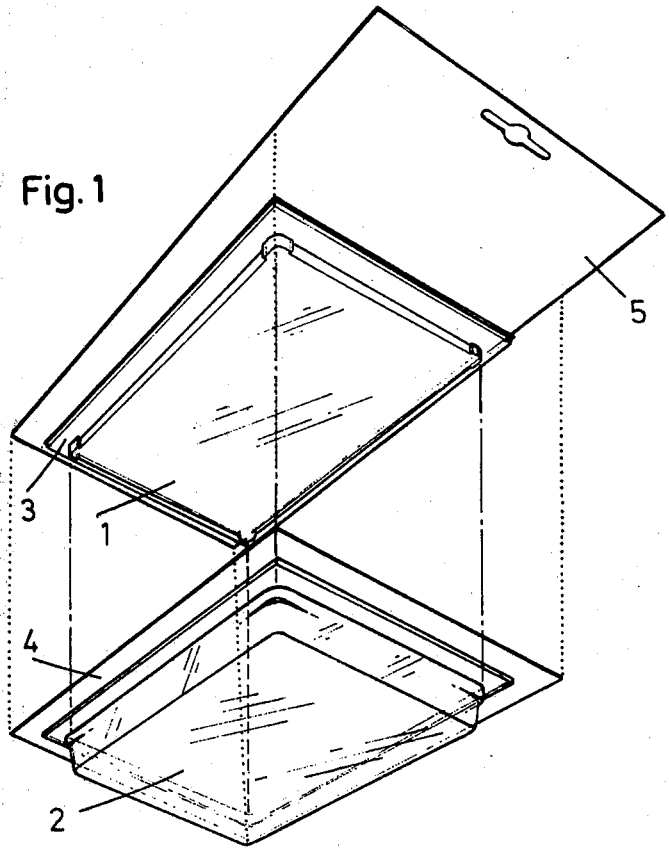
FIG. 1 is a perspective showing of the components of the blister pack according to the invention, whereby the cover bears on the support and the box-like holder removed from said support is not yet welded thereon.

The blister pack as shown in the figures is comprised of a cover 1 for a box-shaped holder 2. This holder 2 includes an inner narrow rim and an outer wider rim 4 with a step being formed between these rims such that when cover 1 is inserted into holder 2, the underlying narrow rim 3 of cover 1 fits within the recesses of the inner narrow rim of holder 2.

After filling the box-like holder, the cover 1 is clamped on said holder 2. The holder 2 provided with cover 1 thereof is now welded with wider rim 4 on a support 5, by some technique known per se.

To remove said box-like holder with cover 1 along a clean-cut line from support 5, said wide rim 4 may now be cut through with a knife along the underlying narrow rim 3 from said cover. The cutting line is shown in FIG. 2 by a dotted line 6. Said cutting line thus runs along the edge from narrow rim 3 of said cover 1.

There results clearly therefrom that it is possible without any difficulty to remove the blister pack from the support thereof, without having small pieces of support 5 remain clinging to rim 3 from cover 1, or to rim 4 from said box-like holder 2.

There is thus obtained a box with cover, which may be of further use.

Various blister packs cut loose in this way from the support 5 thereof may be piled on one another, because the bottom of said box-like holder 2 fits into the center recess of said cover 1.

It must be understood that the invention is in no way limited to the above embodiments and that many changes may be brought therein without departing from the scope of the invention as defined by the appended claims.

We claim:

1. A blister pack container comprising, a box-shaped holder and a corresponding cover for said holder, said holder comprising a lower inner rim and an upper outer rim with a step being defined between said inner and outer rims, said cover including a support and a downwardly projecting underlying rim which inserts into said inner rim of said holder when said cover is inserted into said holder, said cover underlying rim and said lower inner and upper outer holder rims extending substantially fully around the peripheries of said cover and holder respectively, and said holder being initially attached to said cover by securing said upper outer rim of said holder to said support, and said cover being removable from said holder by cutting through the blister pack through said upper outer rim around said step to remove the outer rim and the support to which it is attached, leaving said holder with its inner rim and the step and said cover with its downwardly projecting underlying rim on top of said inner rim to form a reusable and reopenable container.

2. Blister pack as defined in claim 1, in which said outer rim from the box-like holder is wider than the rim of said cover, and the wider part is made fast to the support, for instance by welding.

3. Blister pack as defined in claim 1, in which said box-like holder is provided with flanges running at an angle to the edges, in such a way that the bottom of said box-like holder fits into a center recess of the cover and a plurality of blister packs can be piled on one another.

* * * * *